US007318581B2

(12) United States Patent
Robards, Jr. et al.

(10) Patent No.: US 7,318,581 B2
(45) Date of Patent: Jan. 15, 2008

(54) CARBONATING APPARATUS

(75) Inventors: Chester F. Robards, Jr., Flora, MS (US); George W. Knoll, Belvidere, IL (US)

(73) Assignee: Natural Choice Corporation, Belvidere, IL (US)

( * ) Notice: Subject to any disclaimer, the term of this patent is extended or adjusted under 35 U.S.C. 154(b) by 195 days.

(21) Appl. No.: 11/194,313

(22) Filed: Aug. 1, 2005

(65) Prior Publication Data

US 2007/0023935 A1 Feb. 1, 2007

(51) Int. Cl.
*B01F 3/04* (2006.01)

(52) U.S. Cl. ..... 261/59; 261/79.2; 261/95; 261/DIG. 7

(58) Field of Classification Search ..... 261/42, 261/53, 59, 62, 94, 95, DIG. 7, 79.2
See application file for complete search history.

(56) References Cited

U.S. PATENT DOCUMENTS

| | | | | | |
|---|---|---|---|---|---|
| 641,684 | A | * | 1/1900 | Ferry | 261/159 |
| 656,034 | A | * | 8/1900 | Murphy | 261/19 |
| 841,247 | A | * | 1/1907 | Higginson | 261/43 |
| 1,592,305 | A | * | 7/1926 | Lewis | 261/43 |
| 1,945,489 | A | | 1/1934 | Manley | |
| 2,072,350 | A | | 3/1937 | Walker et al. | |
| 2,094,778 | A | | 10/1937 | Alexander | |
| 2,201,430 | A | | 5/1940 | Deibel | |
| 2,229,441 | A | | 1/1941 | Carlson | |
| 2,263,892 | A | | 11/1941 | Schaer | |
| 3,761,066 | A | | 9/1973 | Wheeler | |
| 3,851,797 | A | | 12/1974 | Jacobs | |
| 3,874,277 | A | | 4/1975 | Sonetaka et al. | |
| 3,958,945 | A | | 5/1976 | Takahashi | |
| 3,960,164 | A | * | 6/1976 | Kelley | 137/202 |
| 4,520,950 | A | * | 6/1985 | Jeans | 222/129.1 |
| 4,555,371 | A | * | 11/1985 | Jeans | 261/122.1 |
| 5,037,584 | A | | 8/1991 | Toll | |
| 5,088,436 | A | * | 2/1992 | Stritmatter | 141/234 |
| 5,118,010 | A | | 6/1992 | Jeans | |
| 5,179,799 | A | * | 1/1993 | Brown et al. | 261/39.1 |
| 5,251,789 | A | | 10/1993 | Jeans | |
| 5,510,060 | A | | 4/1996 | Knoll | |
| 2006/0125128 | A1 | * | 6/2006 | Page et al. | 261/121.1 |

FOREIGN PATENT DOCUMENTS

| | | | |
|---|---|---|---|
| GB | 2013096 | * | 8/1979 |

* cited by examiner

*Primary Examiner*—Scott Bushey
(74) *Attorney, Agent, or Firm*—John R. Hoffman

(57) ABSTRACT

A carbonating apparatus includes an elongated carbonation chamber defining a longitudinal axis and having an inlet end and an outlet end. A manifold assembly is provided at the inlet end of the carbonation chamber. The manifold assembly includes a manifold body having an outlet end connected to the inlet end of the carbonation chamber and an inlet end. A liquid passage and a carbon dioxide passage extend in a direction between the inlet and outlet ends of the manifold body in communication with the inlet end of the carbonation chamber. At least one check valve is disposed inside the liquid passage within the manifold body. At least one check valve is disposed inside the carbon dioxide passage within the manifold body.

26 Claims, 9 Drawing Sheets

CARBONATING APPARATUS

FIELD OF THE INVENTION

This invention generally relates to an apparatus for carbonating a liquid.

BACKGROUND OF THE INVENTION

Apparatus for mixing gases and liquids and, particularly, carbonating apparatus for mixing carbon dioxide with water to produce carbonated water, are well known in the art. It can be appreciated that the quality of carbonated water depends primarily upon the thoroughness with which carbon dioxide is dissolved in the water. Good quality carbonated water is highly effervescent because of the thorough dissolving of carbon dioxide with the water. If the carbon dioxide is not thoroughly mixed with the water, the gas may be wasted and the quality or grade of the carbonated water will be poor.

It also can be appreciated that if carbon dioxide is brought into contact with water and mixed extensively over a long period of time in a large carbonating apparatus where mixing of the carbon dioxide and water can be repeated, it is possible to produce high quality carbonated water. However, carbonating water in a small scale apparatus, such as in-home drink dispensers, proper carbonation of the water becomes more difficult. All kinds of problems are encountered with small scale carbonating apparatus ranging from problems with the liquid and gas flow rates to spitting or sputtering which occurs upon initial operation due to a build up of pressure caused in part by the separation of gas and water. Probably the most critical problem with small scale apparatus, such as for in-home use, is that prior art carbonating apparatus tend to be unduly complicated, involve multiple components and are more expensive than should be expected for ordinary home applications. Prior carbonators are bulky, with valves and other components projecting outwardly from the carbonating housing or chamber. The present invention is directed to solving this myriad of problems and providing a very effective yet simple, compact and inexpensive carbonating apparatus.

SUMMARY OF THE INVENTION

An object, therefore, of the invention is to provide a new and improved apparatus for carbonating a liquid such as water.

In the exemplary embodiment of the invention, the carbonating apparatus includes an elongated carbonation chamber defining a longitudinal axis and having an inlet end and an outlet end. A manifold assembly is provided at the inlet end of the carbonation chamber. The manifold assembly includes a manifold body having an outlet end connected to the inlet end of the carbonation chamber and an inlet end. A liquid passage and a carbon dioxide passage extend in a direction between the inlet and outlet ends of the manifold body in communication with the inlet end of the carbonation chamber. At least one check valve is disposed inside the liquid passage within the unitary manifold body. At least one check valve is disposed inside the carbon dioxide passage within the manifold body.

As disclosed herein, a pair of check valves are disposed in-line inside the liquid passage within the manifold body. Preferably, the body is a one-piece structure, such as being molded of plastic material. A conduit fitting is disposed inside each of the liquid and carbon dioxide passages substantially within the manifold body at inlet openings to the passages.

According to one aspect of the invention, a flow restrictor is provided at the outlet end of the elongated carbonation chamber to control the back pressure therewithin. In the preferred embodiment, the carbonation chamber is defined by a chamber body having an outlet passage at the outlet end of the chamber. The flow restrictor is disposed inside the outlet passage within the chamber body. The manifold body and the chamber body may be a one-piece structure, such as being molded of plastic material.

According to another aspect of the invention, a flow restrictor may be provided in the carbon dioxide line leading to the liquid passage. Preferably, the flow restrictor is located within the manifold body.

According to one embodiment of the invention, the elongated carbonation chamber is filled with a plurality of diffusion beads for mixing and dissolving the carbon dioxide in the liquid. In another embodiment of the invention, the elongated carbonation chamber has a generally cylindrical inner surface. An elongated inner diffusion plug is disposed in the chamber. The plug has a helical flow passage in an outside surface thereof and combines with the cylindrical inner surface of the chamber to define a spiral diffusion passage between the inlet and outlet ends of the elongated carbonation chamber.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
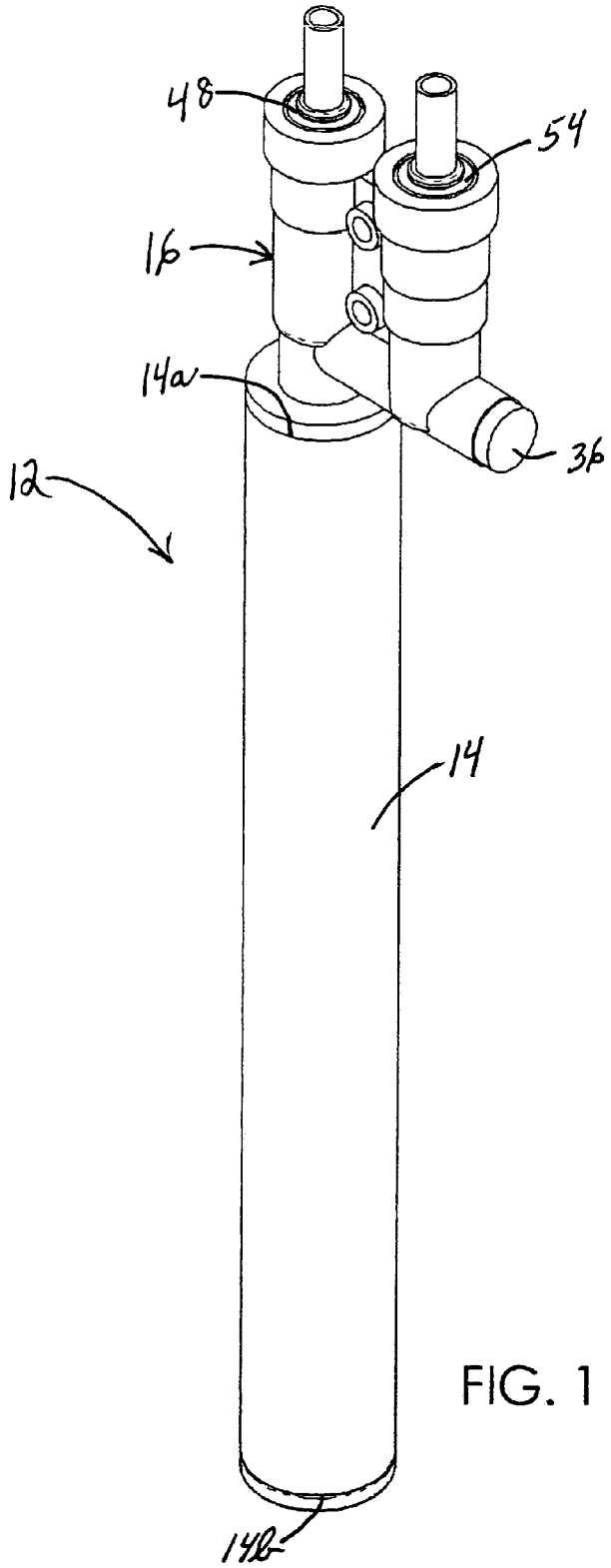
FIG. 1 is a perspective view of a carbonating apparatus according to the invention.

Referring to the drawings in greater detail, and first to FIG. 1, the invention is embodied in a carbonating apparatus ("carbonator"), generally designated 12. The carbonator includes an elongated carbonation chamber 14 having an inlet end 14*a* and an outlet end 14*b*. A manifold assembly, generally designated 16, is mounted at the inlet end of the carbonation chamber. The manifold assembly is a self-contained assembly or module with many of the major functional components of the carbonator mounted entirely within or substantially entirely within the manifold assembly, as will be seen below.

Figure 2:
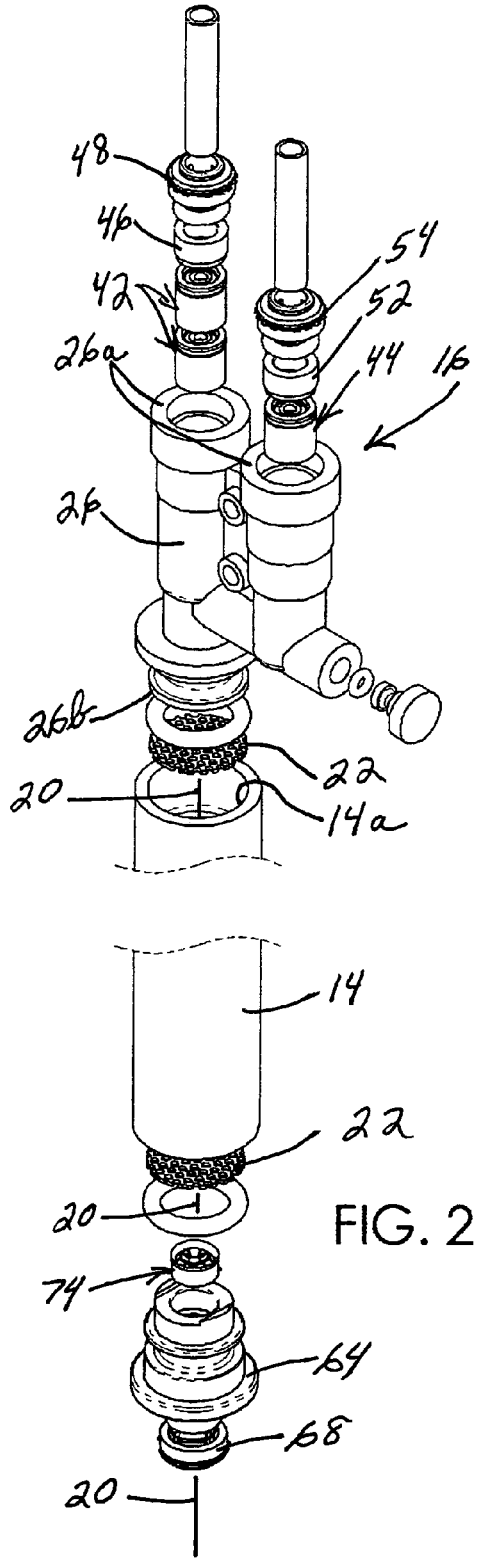
FIG. 2 is an exploded perspective view of the apparatus, with a fragmentation through the carbonation chamber.
Figure 3:
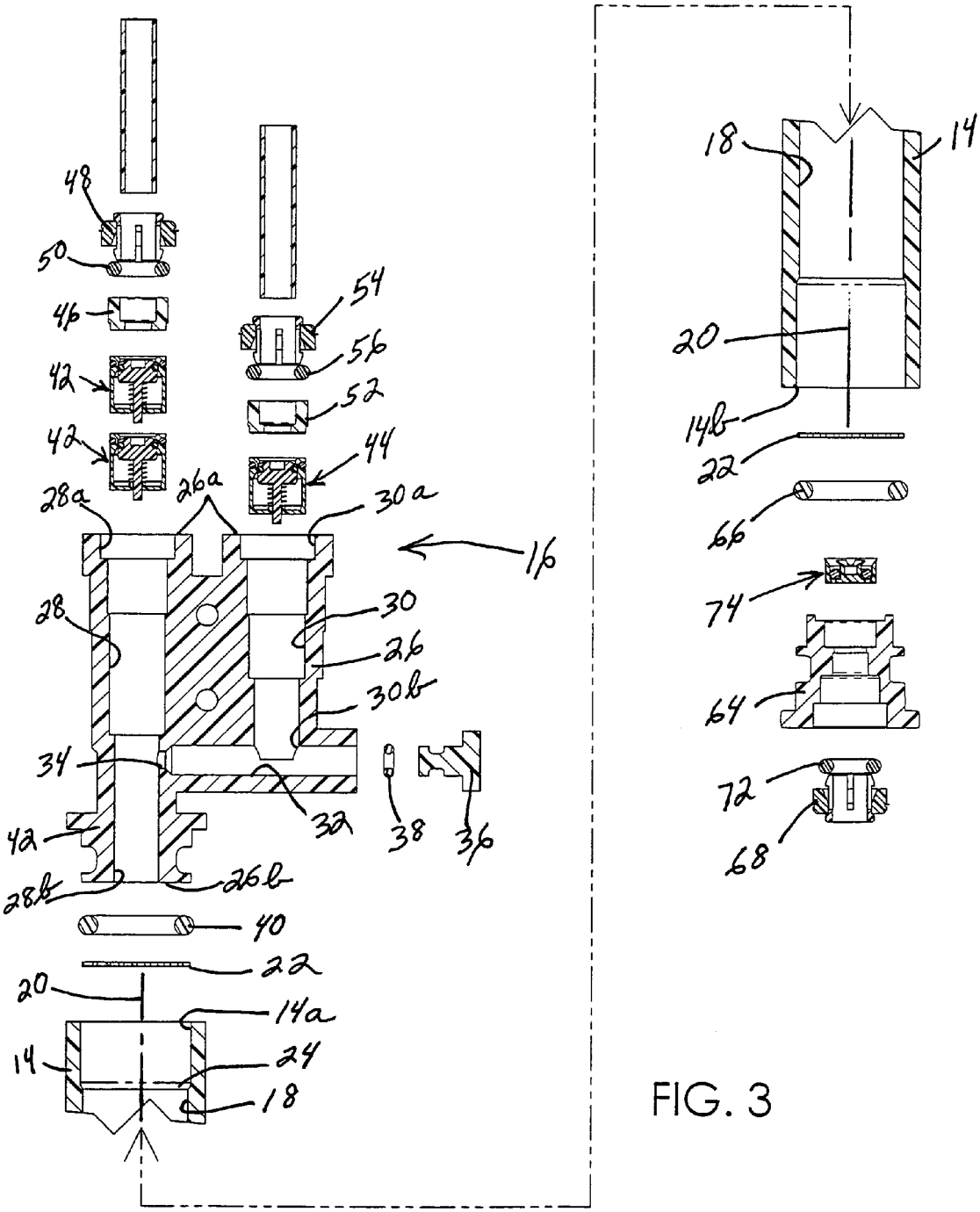
FIG. 3 is an enlarged, exploded section through the components of the apparatus, again with a fragmentation through the carbonation chamber.

Referring to FIGS. 2 and 3 in conjunction with FIG. 1, the elongated carbonation chamber 14 includes a through passage 18 (FIG. 3) extending between inlet end 14*a* and outlet end 14*b* of the chamber. In essence, the elongated carbonation chamber defines a longitudinal axis 20. A pair of screens 22 are positioned into a pair of counterbores 24 (FIG. 3) within through passage 18 near opposite ends of the carbonation chamber, for purposes described hereinafter.

Still referring to FIGS. 2 and 3 in conjunction with FIG. 1, manifold assembly 16 includes a unitary manifold body 26 having an inlet end 26*a* and an outlet 26*b*. The outlet end is connected to or inserted into the inlet end 14*a* of carbonation chamber 14. A liquid (water) passage 28 and a carbon dioxide passage 30 extend in a direction between inlet and outlet ends 26*a* and 26*b*, respectively, of the manifold body in communication with inlet end 14*a* of the carbonation chamber. Passages 28 and 30 are generally parallel to each other and generally parallel to the longitudinal axis 20 of the carbonation chamber. Water passage 28 has an inlet end 28*a* and outlet end 28*b*. Carbon dioxide passage 30 has an inlet end 30*a* and an outlet end 30*b*. The outlet end of the carbon dioxide passage is in communication with a cross passage 32 which leads to water passage 28 at a reduced-diameter juncture 34. As stated above, manifold body 26 may be a one-piece structure molded of plastic material or the like, and cross passage 32 would be formed by an appropriate molding core pin. A plug 36 and an O-ring seal 38 are used to close cross passage 32. The plug may be fabricated of plastic material, and the plug may be bonded in the cross passage by epoxy, ultrasonic welding or the like, and seal 38 is provided for extra sealing protection. Similarly, an O-ring seal 40 surrounds a neck portion 42 of manifold body 26. The neck portion is inserted into inlet end 14*a* of carbonation chamber 14 and fixed therein by various means such as an epoxy or by ultrasonic welding, with seal 40 again providing extra sealing protection.

Figure 4:
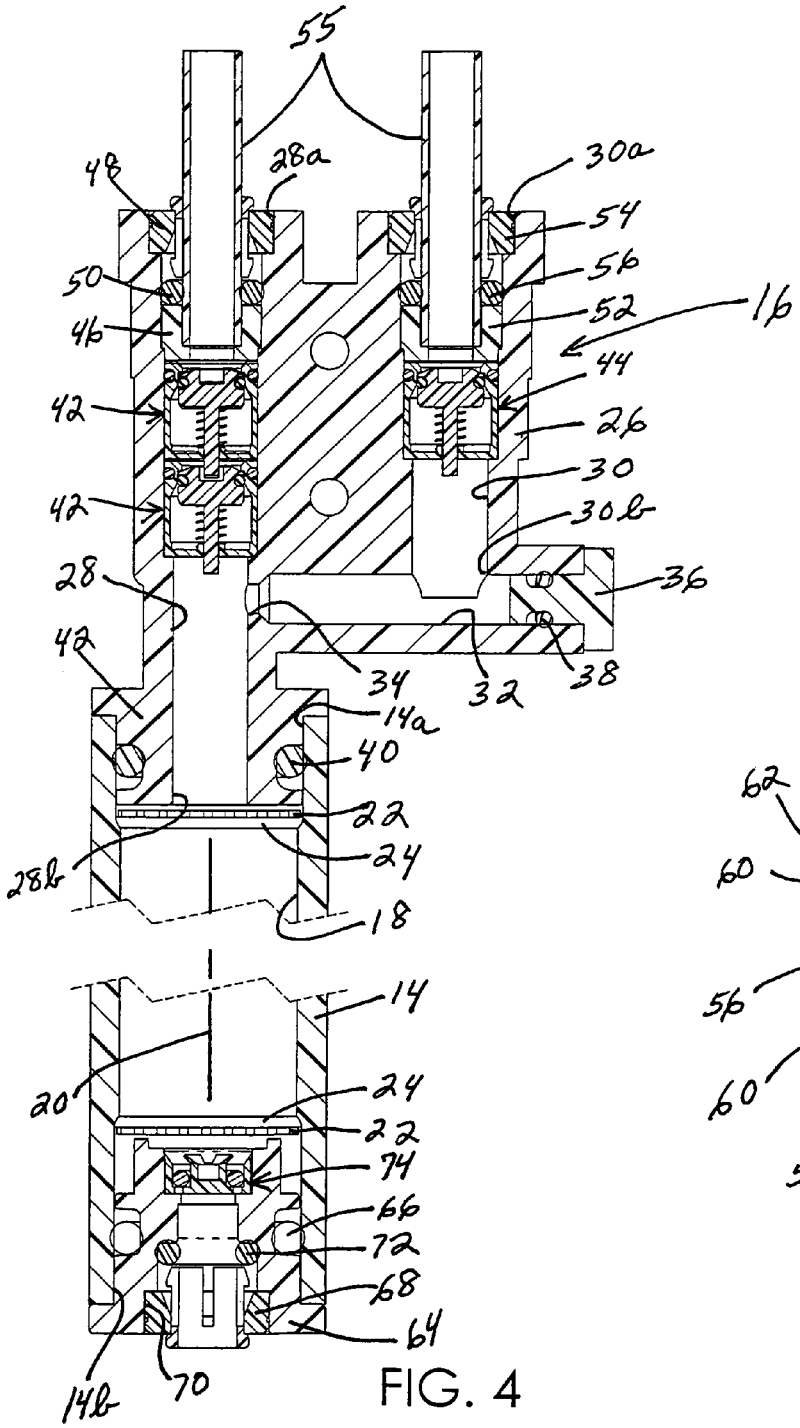
FIG. 4 is a longitudinal section, on a further enlarged scale, through the apparatus, again with a fragmentation through the carbonation chamber.

Referring to FIG. 4 in conjunction with FIG. 3, a pair of in-line check valve assemblies, generally designated 42, are disposed entirely within water passage 28 of manifold body 26. A single check valve assembly, generally designated 44, is disposed entirely within the carbon dioxide passage 30 of the manifold body. Check valve assemblies 42 are held within the liquid passage by a spacer 46 and a conduit fitting 48, with an O-ring seal 50 inside the fitting. Similarly, check valve assembly 44 is held within the carbon dioxide passage 30 by a spacer 52, a conduit fitting 54 and an O-ring seal 56 inside the fitting. The conduit fittings 48 and 54 may be epoxied or ultrasonic welded within the inlet ends 28*a* and 30*a* of the water and carbon dioxide passages 28 and 30, respectively. The conduit fittings also could be press-fit into the inlet ends of the passages, or the fittings could be screwed into the inlet ends. The fittings are provided for receiving appropriate water and gas conduits 55 leading from appropriate sources of the water and carbon dioxide gas.

Figure 4A:
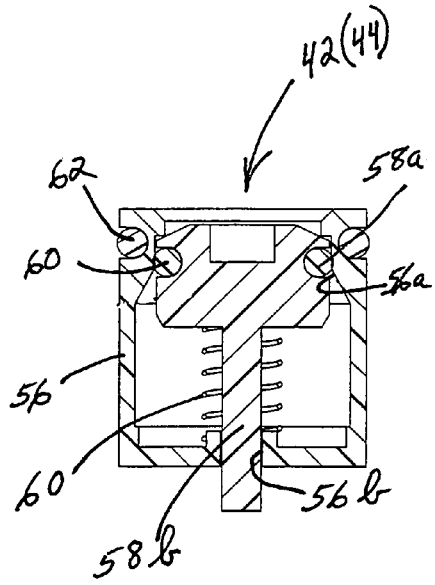
FIG. 4A is a longitudinal section through one of the check valve assemblies.

Two check valve assemblies 42 are provided in liquid passage 28 for redundancy and safety purposes and to meet local, regional, state and/or national specifications. Referring best to FIG. 4A, each check valve assembly 42 or 44 includes a generally hollow housing 56 defining a valve seat 56*a*. A check valve 58 is reciprocally mounted within the housing and is surrounded by an elastomeric O-ring 58*a* which engages valve seat 56*a*. The check valve has a valve stem 58*b* which projects through a hole 56*b* in the housing to guide the reciprocating movement of the valve. A coil spring 60 surrounds valve stem 58*b* and constantly biases check valve 58 and O-ring 58*a* against valve seat 56*a*. Finally, another O-ring seal 62 surrounds housing 56 and engages the inside surface of the respective water or carbon dioxide passage.

Referring again to FIGS. 3 and 4, outlet end 14*b* of carbonation chamber 14 is closed by an end cap 64 which may be epoxied in place or press-fit, ultrasonic welded or screwed into the outlet end. An O-ring seal 66 surrounds the end cap and engages the inside surface of through passage 18 in the carbonation chamber. A conduit fitting 68 is fixed within a recess 70 of end cap 64. Like conduit fittings 48 and 54, fitting 68 receives an appropriate conduit for feeding carbonated liquid or water from carbonation chamber 14 to an appropriate dispensing means. Another O-ring seal 72 is located inside conduit fitting 68. A flow restrictor, generally designated 74, is located within end cap 68 and through which the carbonated water must flow. The flow restrictor improves carbonation by providing a back pressure within the carbonation chamber. Preferably, this flow restrictor is a pressure compensating flow restrictor and is used to provide a uniform or constant back pressure within carbonation chamber 14 over a particular range of water inlet pressure. As an example, in actual practice, a 0.26 gpm pressure compensating flow restrictor has been used to provide a uniform or consistent back pressure over a 50-80 psi inlet water pressure which is much lower than the working pressures generally considered necessary for reasonable carbonation.

Figure 5:
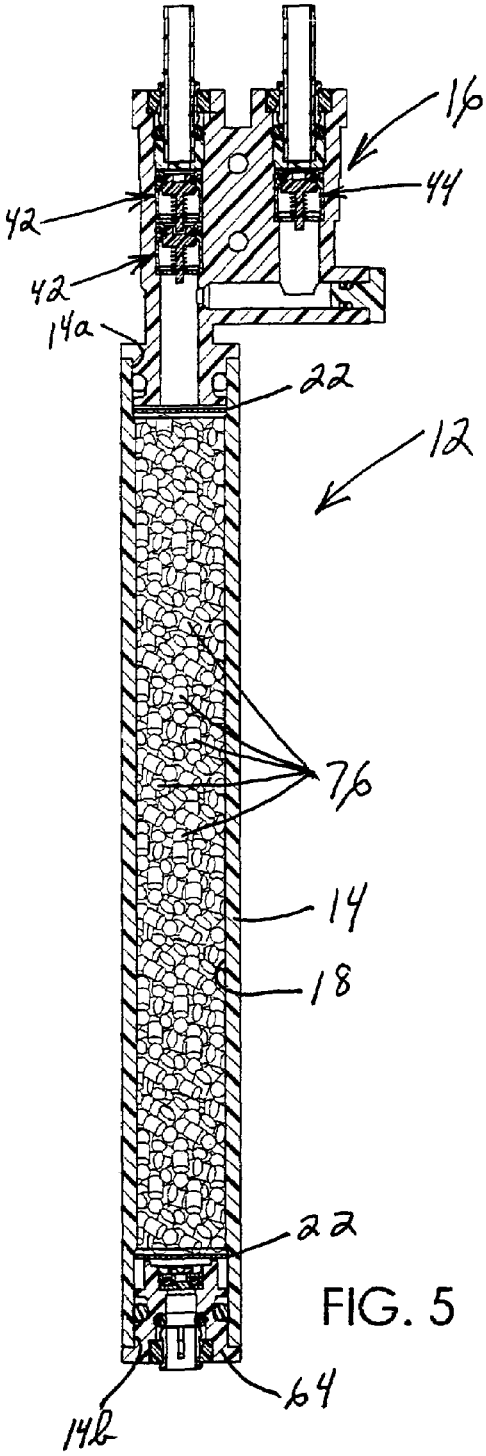
FIG. 5 is a longitudinal section through the apparatus, with the carbonation chamber filled with a plurality of diffusion beads.
Figure 6:
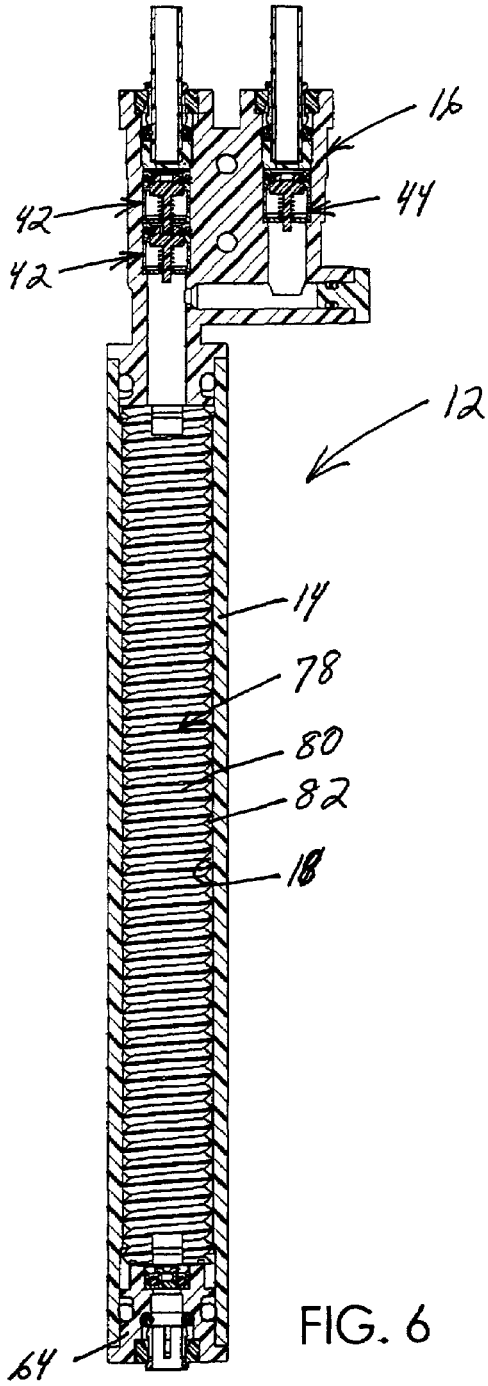
FIG. 6 is a view similar to that of FIG. 5, but of another embodiment with a spiral diffusion plug within the carbonation chamber.

FIGS. 5 and 6 show two different types of diffusion media within the through passage 18 of carbonation chamber 14. In FIG. 5, the through passage within the carbonation chamber is filled with a plurality of diffusion beads 76 which may be fabricated of polycarbonate or the like. The multitude of beads provide a tortuous path between the inlet and outlet ends of the carbonation chamber for mixing of the water and carbon dioxide. The beads are held within the chamber by screens 22, described above.

In FIG. 6, an elongated diffusion plug, generally designated 78, is positioned within carbonation chamber 14. The outer surface of the plug is formed with a helical flow passage 80. Through passage 18 of the carbonation chamber forms a generally cylindrical inner surface. Therefore, the helical flow passage 80 in the outside surface of diffusion plug 78 combines with the cylindrical inner surface of through passage 18 to define a spiral diffusion passage 82 between the inlet and outlet ends of the elongated carbonation chamber 14 and within which the water and carbon dioxide are mixed or diffused to provide a carbonated liquid.

Figure 7:
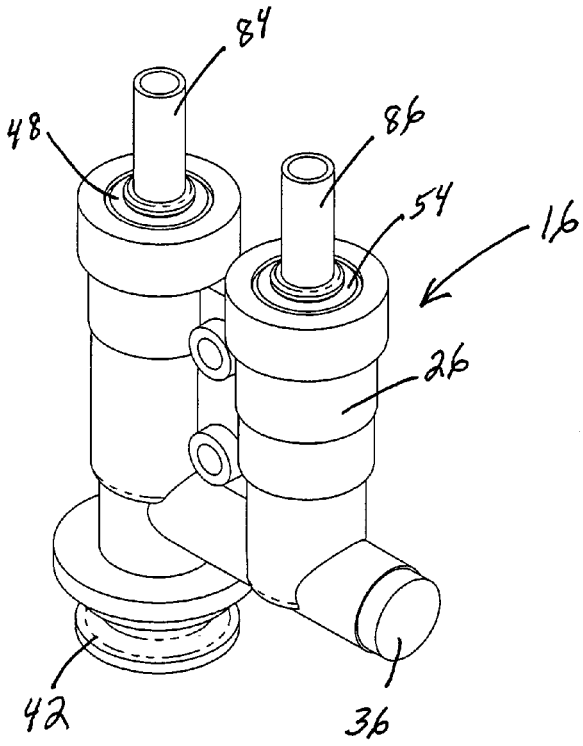
FIG. 7 is a perspective view of the manifold assembly removed from the carbonation chamber.
Figure 8:
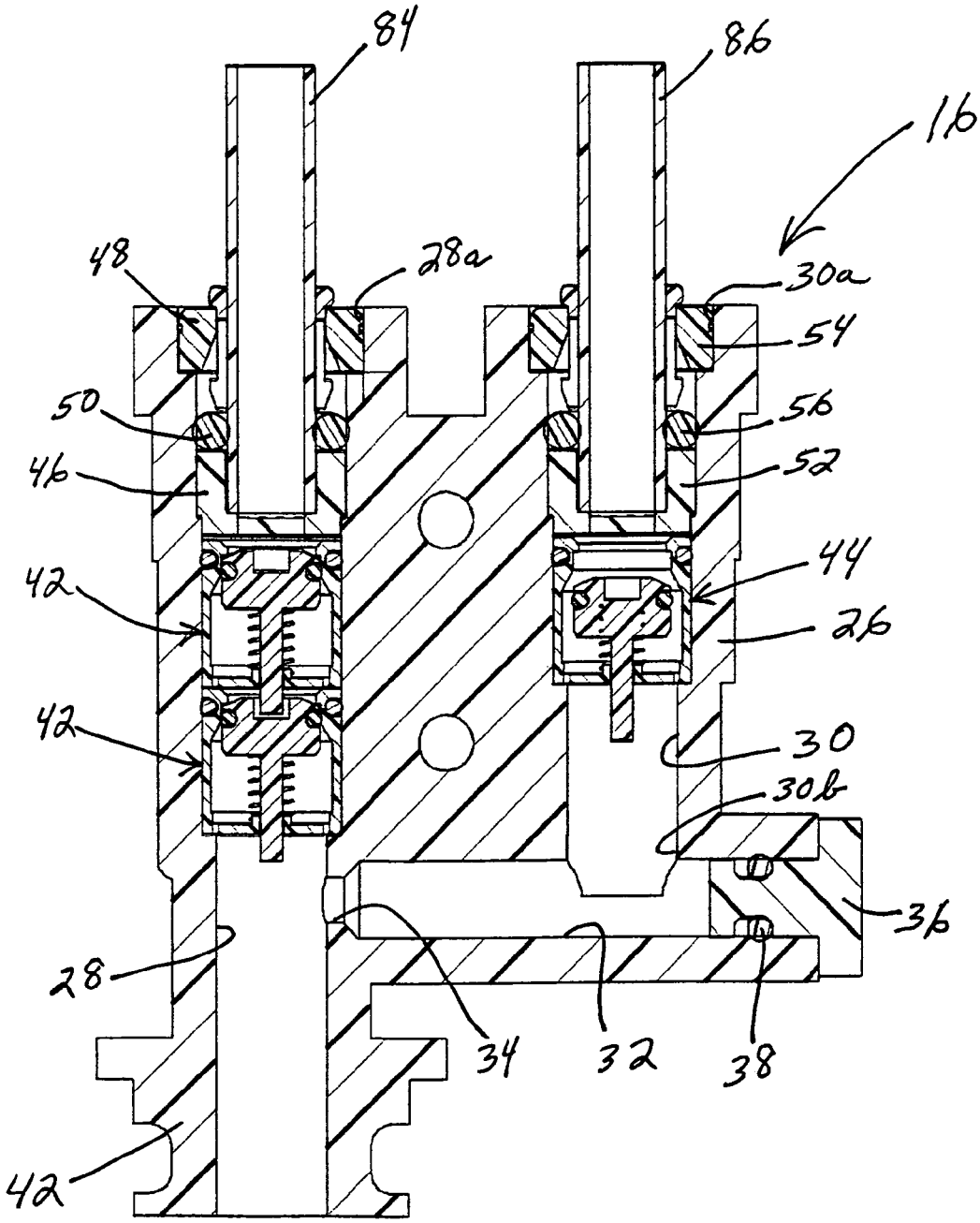
FIG. 8 is an enlarged section through the manifold assembly.

FIGS. 7 and 8 are enlarged perspective and sectional depictions of manifold assembly 16 removed from carbonation chamber 14 to clearly illustrate how the manifold assembly is a self-contained unit. It can be seen that all of the major components including check valve assemblies 42, check valve assembly 44, spacers 46 and 52 and conduit fittings 48 and 54 all are disposed entirely within or substantially entirely within manifold body 26, i.e., within liquid and carbon dioxides passages 28 and 30, respectively. Check valve assembly 44 is shown open in FIG. 8 simply for illustration purposes. It can be seen that there are no check valves nor fittings projecting outwardly in all kinds of directions away from the manifold body as is prevalent with the prior art. The water and carbon dioxide passages extend generally parallel to each other and generally parallel to carbonation chamber 14 so that appropriate water and carbon dioxide conduits 84 and 86, respectively, also extend away from the self-contained manifold assembly in directions generally parallel to the overall axis of the entire carbonator. This provides for a streamlined structural combination which is quite evident in FIGS. 1, 5 and 6 and enables the carbonator to be installed in limited space applications, such as in various areas, cabinets or the like of an ordinary home.

Figure 9:
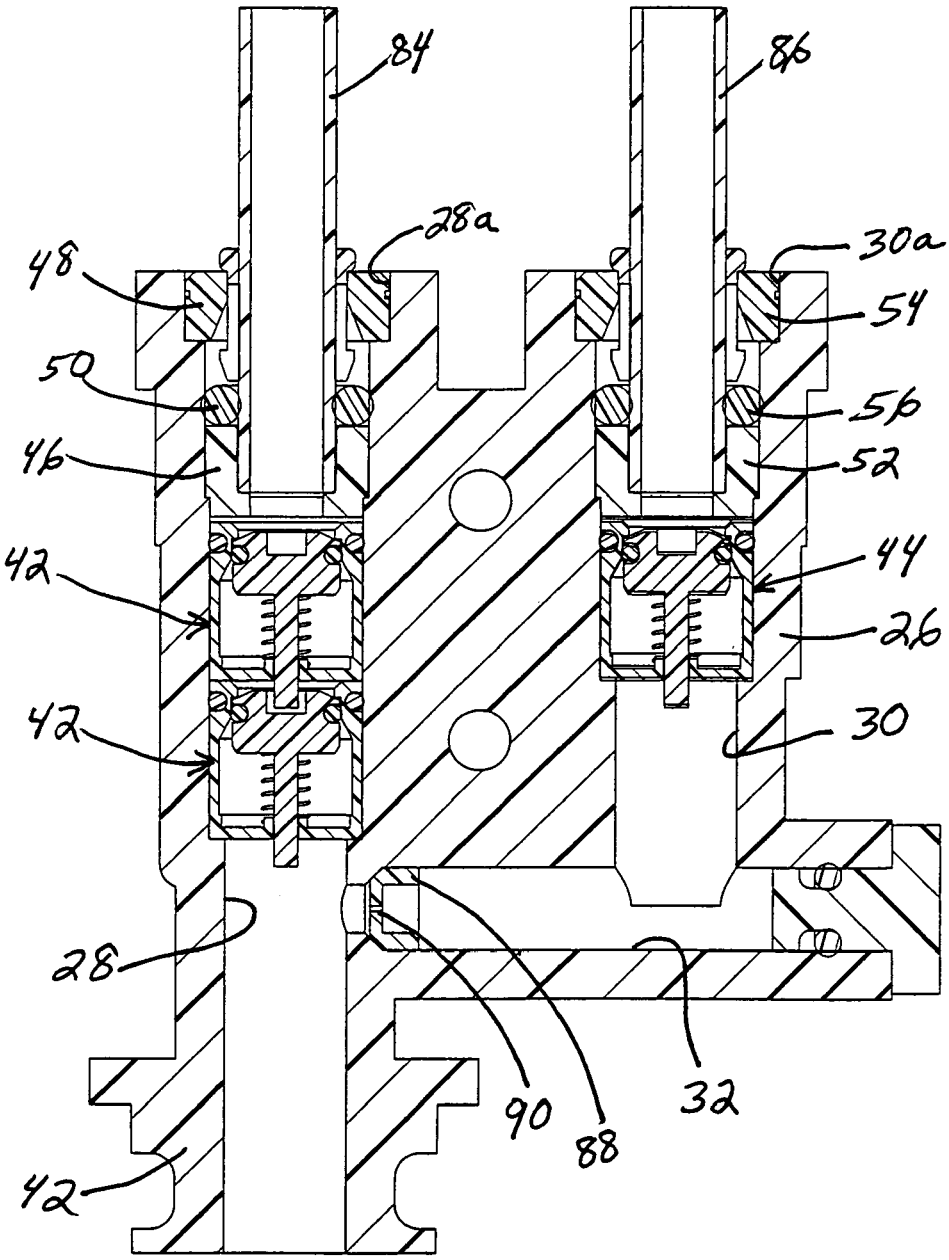
FIG. 9 is a view similar to that of FIG. 8, with a flow restrictor disposed within the gas line.

FIG. 9 is substantially identical to FIG. 8, except that a flow restrictor 88 is located in cross passage 32 of manifold body 26. In other words, the flow restrictor is located in the carbon dioxide passage means which extends through the manifold assembly. The flow restrictor has a small orifice 90 through which the carbon dioxide must pass. The flow restrictor introduces carbon dioxide to the water under a given injection pressure and a desired flow rate (determined by the restrictor orifice) to improve mixing with the water. It has been found that this pressure should be at least equal to the water pressure, although some variance is contemplated. A pressure compensating flow restrictor, of a given value, also could be used.

Figure 10:
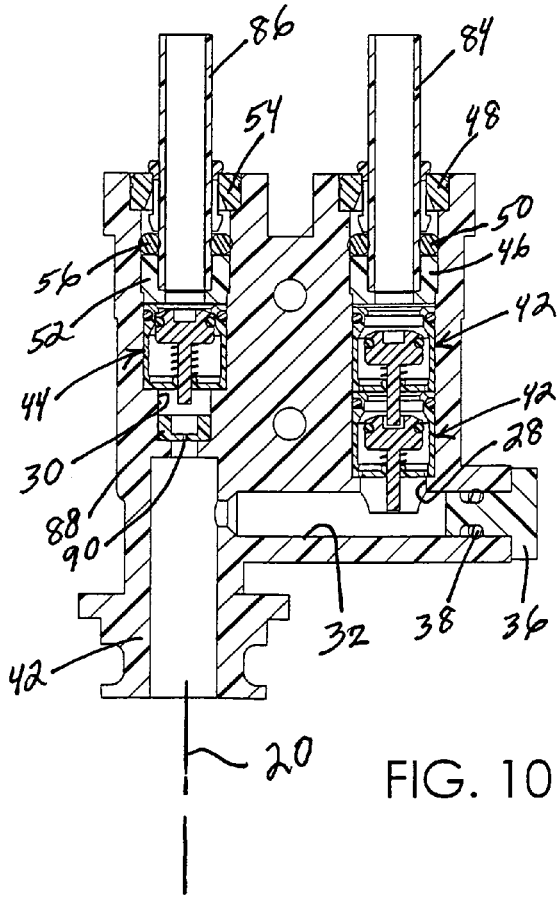
FIG. 10 is a view similar to that of FIG. 8, but with the carbon dioxide passage in-line with the carbonation chamber.

FIG. 10 shows an alternative embodiment of the invention, wherein the carbon dioxide passage 30 and check valve assembly 44 are in-line with axis 20 of the carbonation chamber. Water passage 28 and check valve assemblies 42 are located just opposite the configuration of FIGS. 2-9. The flow restrictor 90 has been moved from cross passage 32 (FIG. 9) in-line within passage 30.

Figure 11:
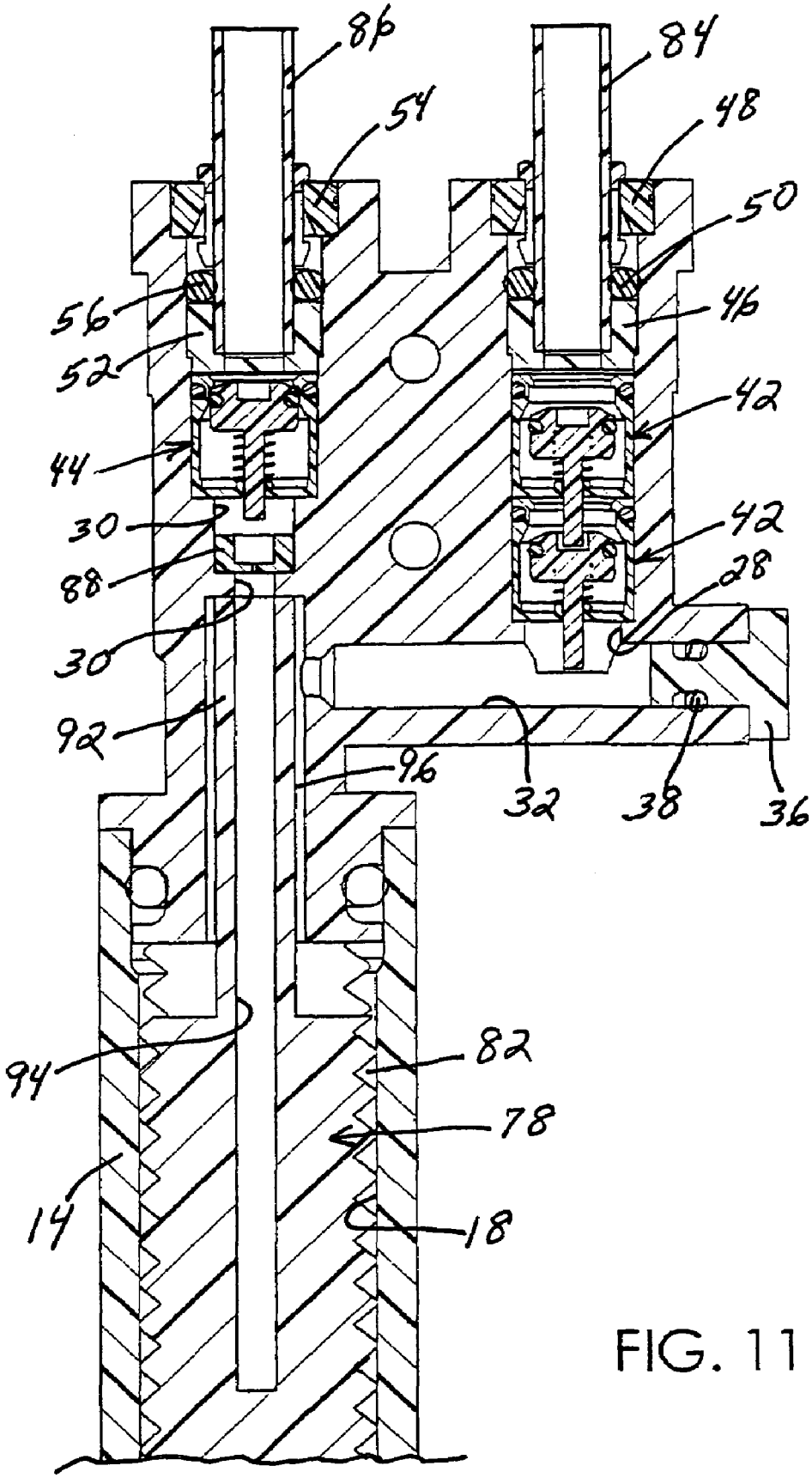
FIG. 11 is a view similar to that of FIG. 10, but of a further embodiment of the invention using a spiral diffusion plug.

FIG. 11 shows a further embodiment of the invention wherein the arrangement of water passage 28, carbon dioxide passage 30 and the respective check valve assemblies 42 and 44 is the same as described above and shown in FIG. 10. However, the embodiment of FIG. 11 includes a diffusion plug, generally designated 78, positioned within through passage 18 of carbonation chamber 14 similar to the embodiment described above in relation to FIG. 6. The diffusion plug in FIG. 11 includes an elongated stem 92 having an inside passage 94 which is in-line with carbon dioxide passage 30. The inside passage extends considerably into diffusion plug 78, and the plug is fabricated of microporous material for diffusing carbon dioxide gas outwardly through the plug into the spiral diffusion passage 82 described above in relation to FIG. 6. The water flows from cross passage 32 into a cylindrical passage 96 about the outside of elongated stem 92. Elongated passage 96 is in communication with spiral passage 82, whereupon the carbon dioxide gas diffusing through plug 78 mixes with the water within spiral passage 82.

Figure 12:
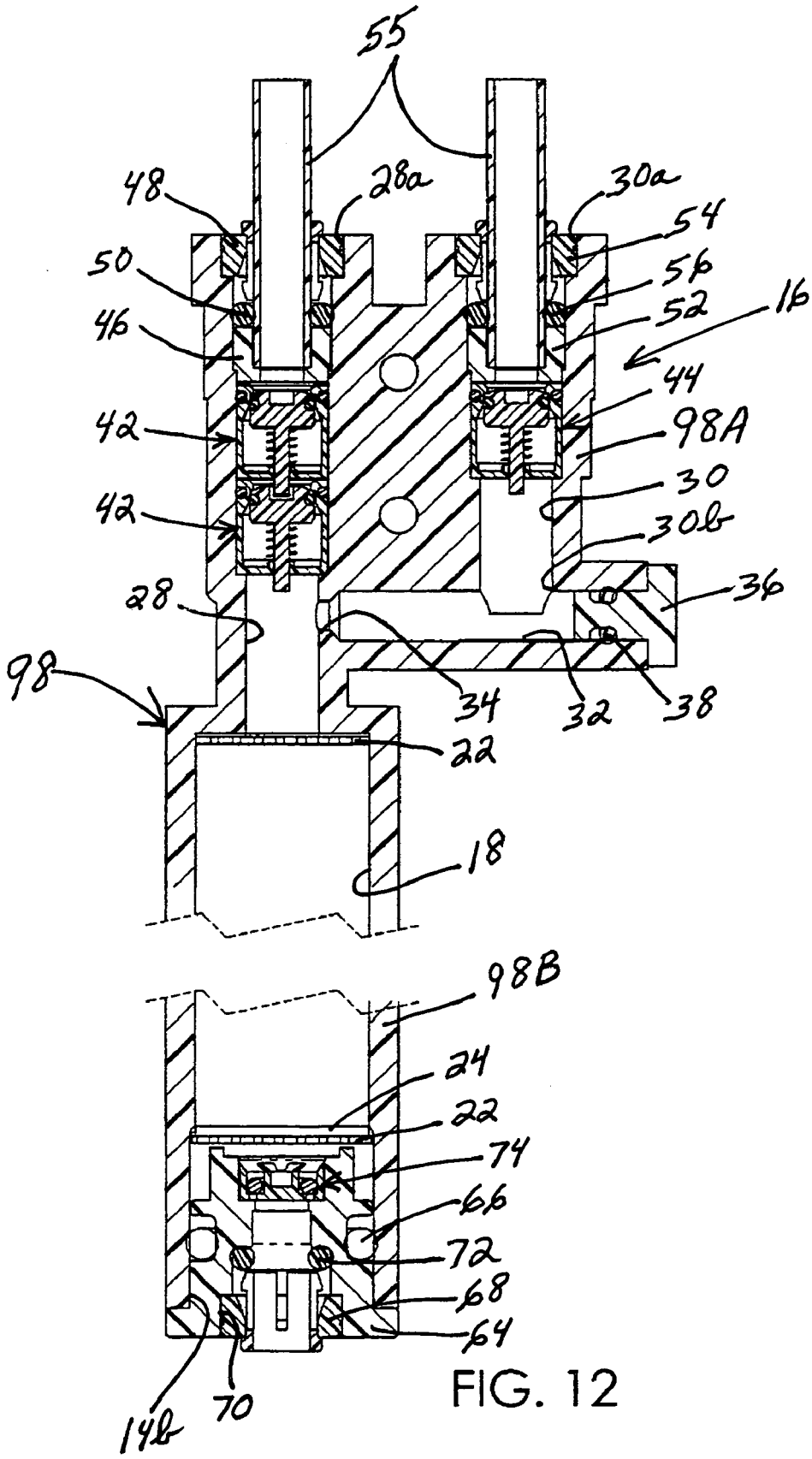
FIG. 12 is a view similar to that of FIG. 4, but of still another embodiment of the invention.

FIG. 12 shows still another embodiment of the invention and should be compared to FIG. 4. Like reference numerals have been applied in FIG. 12 corresponding to like components described above in relation to FIG. 4, and the description of those components will not be repeated. In the embodiment of FIG. 12, a one-piece body, generally designated 98, is fabricated to form a manifold body portion 98A and a carbonation chamber body portion 98B. For instance, the one-piece body may be molded of plastic material. This would lead to considerable cost savings. The upper screen 22 simply is sized to press-fit into the end of chamber 18.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. An apparatus for carbonating a liquid, comprising:

an elongated carbonation chamber defining a longitudinal axis and having an inlet end and an outlet end; and a manifold assembly at the inlet end of the carbonation chamber and including a manifold body having an outlet end connected to the inlet end of the carbonation chamber and an inlet end, a liquid passage and a carbon dioxide passage extending in a direction between the inlet and outlet ends of the manifold body in communication with the inlet end of the carbonation chamber, at least one check valve inside the liquid passage and contained within and substantially surrounded by the manifold body, and at least one check valve inside the carbon dioxide passage and contained within and substantially surrounded by the manifold body.

2. The apparatus of claim 1, including a flow restrictor at the outlet end of the elongated carbonation chamber.

3. The apparatus of claim 2 wherein said flow restrictor is a pressure compensating flow restrictor.

4. The apparatus of claim 2 wherein said carbonation chamber is defined by a chamber body having an outlet passage at the outlet end of the carbonation chamber, and said flow restrictor is disposed inside the outlet passage within the chamber body.

5. The apparatus of claim 1, including a pair of check valves in-line inside the liquid passage within the unitary manifold body.

6. The apparatus of claim 1 wherein said manifold body is a one-piece structure.

7. The apparatus of claim 1 wherein said carbonation chamber is defined by a chamber body, and the chamber body and said manifold body comprise a one-piece structure.

8. The apparatus of claim 1, including a conduit fitting inside each of said liquid and carbon dioxide passages substantially within the manifold body at inlet openings to the passages.

9. The apparatus of claim 1, including a flow restrictor in the carbon dioxide passage within the manifold body.

10. The apparatus of claim 1, including a plurality of diffusion beads inside the elongated carbonation chamber.

11. The apparatus of claim 1 wherein said elongated carbonation chamber has a generally cylindrical inner surface, and including an elongated inner diffusion plug in the chamber, the plug having a helical flow passage in an outside surface thereof and combining with the cylindrical inner surface of the chamber to define a spiral diffusion passage between the inlet and outlet ends of the elongated carbonation chamber.

12. The apparatus of claim 1 wherein said generally parallel liquid and carbon dioxide passages communicate with a common outlet passage which is in communication with the inlet end of the carbonation chamber.

13. The apparatus of claim 12 wherein said common outlet passage is parallel to and coincident with the longitudinal axis of the carbonation chamber.

14. The apparatus of claim 13 wherein said liquid passage is in-line with the common outlet passage.

15. The apparatus of claim 1 wherein the liquid and carbon dioxide passages are generally parallel to each other and generally parallel to the longitudinal axis of the carbonation chamber.

16. A manifold assembly for use in a liquid carbonating apparatus having a carbonation chamber with an inlet end and an outlet end, comprising:

a manifold body having an outlet end connected to the inlet end of the carbonation chamber and an inlet end;

a liquid passage and a carbon dioxide passage extending in a direction between the inlet and outlet ends of the manifold body in communication with the inlet end of the carbonation chamber, at least one check valve inside the liquid passage and contained within and substantially surrounded by the manifold body; and at least one check valve inside the carbon dioxide passage and contained within and substantially surrounded by the manifold body.

17. The manifold assembly of claim 16 wherein said carbonation chamber is defined by a chamber body having an outlet passage at the outlet end of the carbonation chamber, and said flow restrictor is disposed inside the outlet passage within the chamber body.

18. The manifold assembly of claim 16 wherein said manifold body is a one-piece structure.

19. The manifold assembly of claim 16 wherein said carbonation chamber is defined by a chamber body, and the chamber body and said manifold body comprise a one-piece structure.

20. The manifold assembly of claim 16, including a conduit fitting inside each of said liquid and carbon dioxide passages substantially within the manifold body at inlet openings to the passages.

21. The manifold assembly of claim 16 wherein said generally parallel liquid and carbon dioxide passages communicate with a common outlet passage which is connected in communication with the inlet end of the carbonation chamber.

22. The manifold assembly of claim 21 wherein said common outlet passage is generally parallel to the liquid and carbon dioxide passages.

23. The manifold assembly of claim 21 wherein said liquid passage is in-line with the common outlet passage.

24. The manifold assembly of claim 16, including a flow restrictor in the carbon dioxide passage within the manifold body.

25. The manifold assembly of claim 16 wherein the liquid and carbon dioxide passages are generally parallel to each other and generally parallel to the longitudinal axis of the carbonation chamber.

26. An apparatus for carbonating a liquid, comprising:

a chamber body defining an elongated carbonation chamber having a longitudinal axis and having an inlet end and an outlet end with an outlet passage at the outlet end;

a manifold assembly at the inlet end of the carbonation chamber and including a liquid passage and a carbon dioxide passage and respective check valves operatively associated with said passages; and a flow restrictor disposed within the chamber body inside the outlet passage at the outlet end of the elongated carbonation chamber.

* * * * *